United States Patent [19]

Abe

[11] Patent Number: 4,989,714

[45] Date of Patent: Feb. 5, 1991

[54] METHOD OF DISCRIMINATING COINS

[75] Inventor: Hiroshi Abe, Tokyo, Japan

[73] Assignee: Asahi Seiko Kabushiki Kaisha, Tokyo, Japan

[21] Appl. No.: 434,328

[22] Filed: Nov. 13, 1989

[30] Foreign Application Priority Data

Nov. 15, 1988 [JP] Japan ..... 63-286736

[51] Int. Cl.[5] ..... G07D 5/08

[52] U.S. Cl. ..... 194/317; 336/225

[58] Field of Search ..... 194/317, 318, 319; 336/225, 226

[56] References Cited

U.S. PATENT DOCUMENTS 4,488,116 12/1984 Plesko ..... 194/319 X
4,815,579 3/1989 Fritz ..... 194/318
4,842,119 6/1989 Abe ..... 194/317

*Primary Examiner*—F. J. Bartuska
*Attorney, Agent, or Firm*—Nilles & Nilles

[57] ABSTRACT

A method of discriminating coins by use of a pair of oval sensor coils opposedly arranged at both sides of a coin passage in a coin acceptor with the longitudinal axis of the coils extended along a coin guide rail in the coin passage is disclosed. The method comprises steps of detecting a variation of coil reactance caused by a coin rolling on the guide rail, counting clock pulses in a pass time from a start point to a final point of the variation of coil reactance, reading the whole variation of the coil reactance from the start point to the final point thereof by a microcomputer, providing a plurality of variation divided data by dividing the pass time by an integral number and comparing the variation data with corresponding reference data of genuine coin or coins previously stored in the microcomputer.

5 Claims, 10 Drawing Sheets

METHOD OF DISCRIMINATING COINS

BACKGROUND OF THE INVENTION

1. Field of the Invention

The present invention relates to a method of discriminating coins, in particular to a method of discriminating coin properties such as a material, diameter and thickness of the coin by using a coin discriminating sensor in the form of a proximity switch.

2. Related Art Statement

There has been known to use a plurality pair of sensor coils for discriminating the material and dimension of the coin in such a manner that sensor coils of the each pair are opposedly arranged on both sides of a coin passage in a coin acceptor so as to detect a variation of an inductance which is generated in the sensor coils by a coin passing through the coin passage when a magnetic field generated by the sensor coils is crossed by the coin.

Hitherto, such a sensor coil used in the aforementioned manner has been generally formed in the form of a circular sensor coil as shown by reference numeral 1 in FIG. 1. However, when three kinds of coins A, B and C of different diameters but the same material cross the magnetic field of the circular sensor coil as shown in FIG. 1, the peak variations of the coil reactance caused by the coins A, B and C occur at the same time position $T_1$ on a time coordinate axis T as shown by variation curves "a", "b" and "c" in FIG. 2. Accordingly, in the prior method of discriminating a plurality of coins having different diameters by using the sensor coils, the coins are discriminated by only the difference of the peak values of the coil reactance occurred at the same time position $T_1$ on the time coordinate axis T.

However, if the diameter of a pair of the opposedly arranged circular sensor coils and/or the position of the circular sensor coils relative to a guide rail 2 on which the coins to be discriminated roll between a pair of the sensor coils is not pertinent for all three kinds of coins, the peak variations can not be distinguished from each other as is noted by comparing the variation curves "b" and "c" shown in FIG. 2, resulting in that the coins B and C can not be discriminated by the peak variations. Furthermore, in order to effect the discrimination of the coin diameter by use of the circular sensor coil, materials of coins to be discriminated must be the same and then additional sensor coils are required for discriminating the material of the coin. Accordingly, it is necessary that a pair of material discriminating sensor coils and a pair of diameter discriminating sensor coils are sequently arranged along the coin passage. Furthermore, it is preferable that the center of magnetic bundle of the material discriminating sensor coil coincides with the center of the coin to be discriminated and the center of magnetic bundle of the diameter discriminating sensor coil coincides with the upper end of coin to be discriminated.

The inventor had invented an oval sensor coil as disclosed in Japanese Patent application Laid-Open publication No. 61-289486 (U.S. Pat. No. 4,842,119). The oval sensor coil has an oval configuration in a section parallel to the coin passage, with one end in the longitudinal direction of the oval configuration having a large radius of curvature and the other end in the longitudinal direction of the oval configuration having a small radius of curvature as shown in FIG. 3.

When a magnetic field generated by a pair of the oval sensor coils 3 is crossed by each of coins A, B and C of different diameters as shown in FIG. 3, which rolls on the guide rail 2 extending between the opposedly arranged the oval sensor coils 3, a resonance portion of an L.C. oscillating circuit connected to the oval sensor coil detects variation of the coil reactance caused by variation of "Q" of the sensor coil and variation of leak magnetic bundle as shown in FIG. 4. The peak reactance $L_a$ caused by the small coin A, the peak reactance $L_b$ caused by the middle coin B and the peak reactance $L_c$ caused by the large coin C occur at different time positions $T_a$, $T_b$ and $T_c$ on the coin detection time axis T, respectively.

Thus, according to the oval sensor coil, a position occurring the peak reactance caused by a coin having a specific diameter can be determined by a clock counter which is started when the variation of the sensor coil reactance caused by the coin begins to occur. Therefore, the discrimination of the materials and dimensions of a plurality of different coins can be accuratelly effected by only a pair of sensor coils since the value of peak reactance occurred at the specific time position for the specific coin diameter is different for the coin material.

SUMMARY OF THE INVENTION

An object of the present invention is to provide a method of discriminating coins by use of a pair of oval sensor coils for accurately discriminating coins having closely resemble diameter and material from genuine coins.

According to the present invention, a method of discriminating coins by use of a pair of oval sensor coils opposedly arranged at both sides of a coin passage in a coin acceptor with the longitudinal axis of the coils extended along a coin guide rail in the coin passage, comprises steps of detecting a variation of coil reactance caused by a coin rolling on the guide rail, counting clock pulses in a pass time from a start point to a final point of the variation of coil reactance, reading the whole variation of the coil reactance from the start point to the final point thereof by a microcomputer, providing a plurality of variation divided data by dividing the pass time by an integral number and comparing the variation data with corresponding reference data of genuine coin or coins previously stored in the microcomputer. The whole variation of coil reactance may be detected in the form of a variation of an oscillation frequency and/or oscillating voltage by an L. C. oscillating circuit connected to the oval sensor coil. The whole variation of coil reactance may be substantially continuously detected.

It is noted from a property of the oval sensor coil that the occurring point of the peak reactance of the sensor coil is varied in the longitudinal direction of the oval sensor coil by the variation of the diameter of the coin and the peak reactance is varied by the variation of the material of the coin and further the whole variation of the coil reactance from the start point to the final point thereof is varied by the variation of combination of the diameter, thickness and material of the coin. Accordingly, the whole variation of the coil reactance which may be substantially continuously recorded is divided by an integral number to provide a plurality of variation divided data representing the whole variation and the variation divided data are compared with corresponding reference data of a genuine coin stored in a microcomputer to effect high accurate discrimination.

When the same genuine coins of the same dimension and material pass at different speeds, the pass time from the start point TA to the final point TZ varies depend on the speed of the coin as shown in the whole variation curves of FIGS. 5 and 6. However, when the whole variation curves are divided by an integral number, for example, sixteen to provide divided data for sixteen divided time points, the divided data for the divided time point of the same number in both whole variation curves are the same reactance values without influence of the difference of the coin speed.

It is preferable to opposedly arrange a pair of the oval sensor coils at the both sides of the inclined coin guide rail with one end in the longitudinal direction of the small radius of curvature RA positioned at the inlet side of the coin passage. At the inlet side of the coin passage, the coin to be discriminated is dropped on an inclined receiving arm of a brake member. The dropped coin is temporarily stopped on the inclined receiving arm by an urging arm of the brake member and subsequently started to roll on the inclined coin guide rail between the oval sensor coils at substantially constant speed.

BRIEF DESCRIPTION OF THE DRAWINGS

The invention, the object and feature of the invention and further objects, features and advantages thereof will be better understood from the following description with reference to the accompanying drawings, in which.

DESCRIPTION OF THE PREFERRED EMBODIMENT

Figure 1:
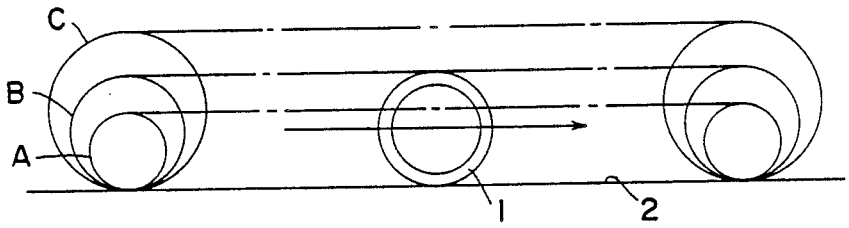
FIG. 1 PRIOR ART
FIG. 1 is a schematic view illustrating three representative coins of different diameters crossing a magnetic field of a conventional circular sensor coil.
Figure 2:
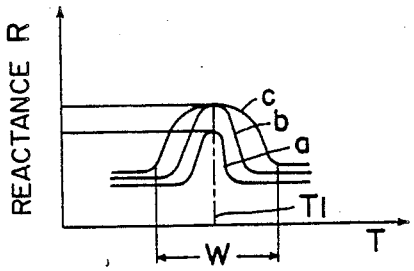
FIG. 2 PRIOR ART
FIG. 2 shows characteristic curves of variations of reactance of the circular sensor coil shown in FIG. 1.
Figure 3:
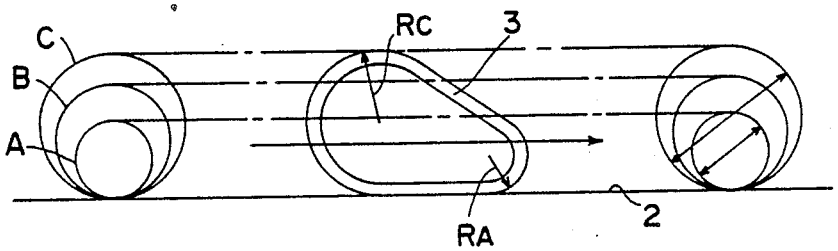
FIG. 3 PRIOR ART
FIG. 3 is a schematic view illustrating three representative coins of different diameters crossing a magnetic field of an oval sensor coil.
Figure 4:
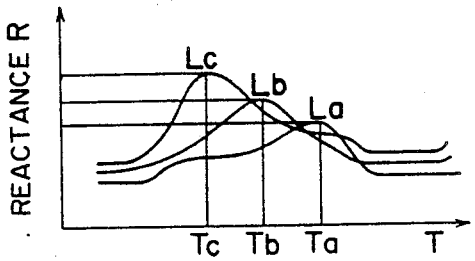
FIG. 4 PRIOR ART
FIG. 4 shows characteristic curves of variations of reactance of the oval sensor coil shown in FIG. 3.
Figure 5:
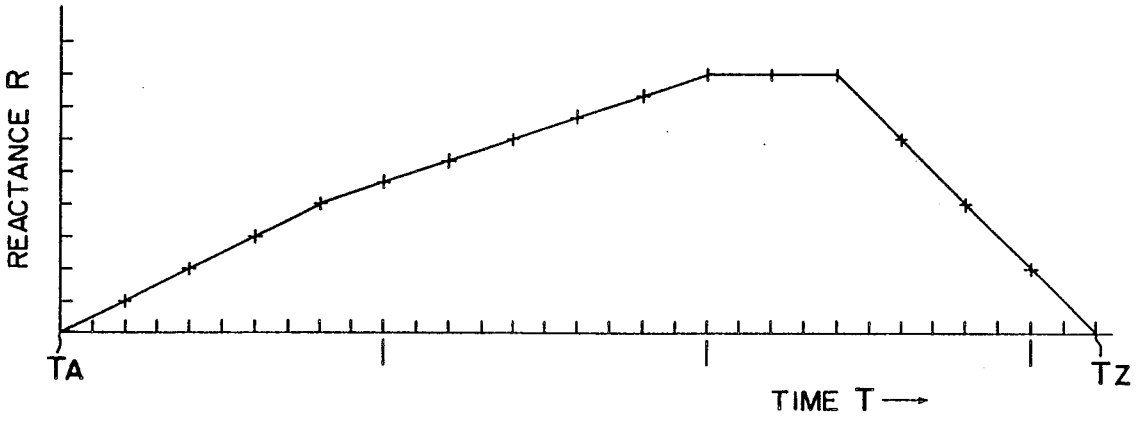
FIGS. 5 and 6 are diagrammatic views showing variations of reactance of the oval sensor coil caused by coins of the same material, thickness and diameter, but passed at different speeds.
Figure 6:
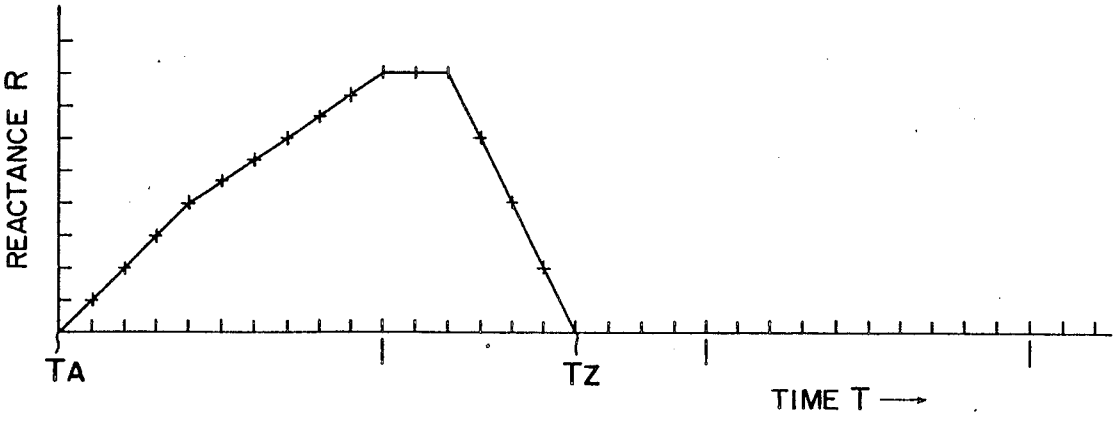
Figure 7:
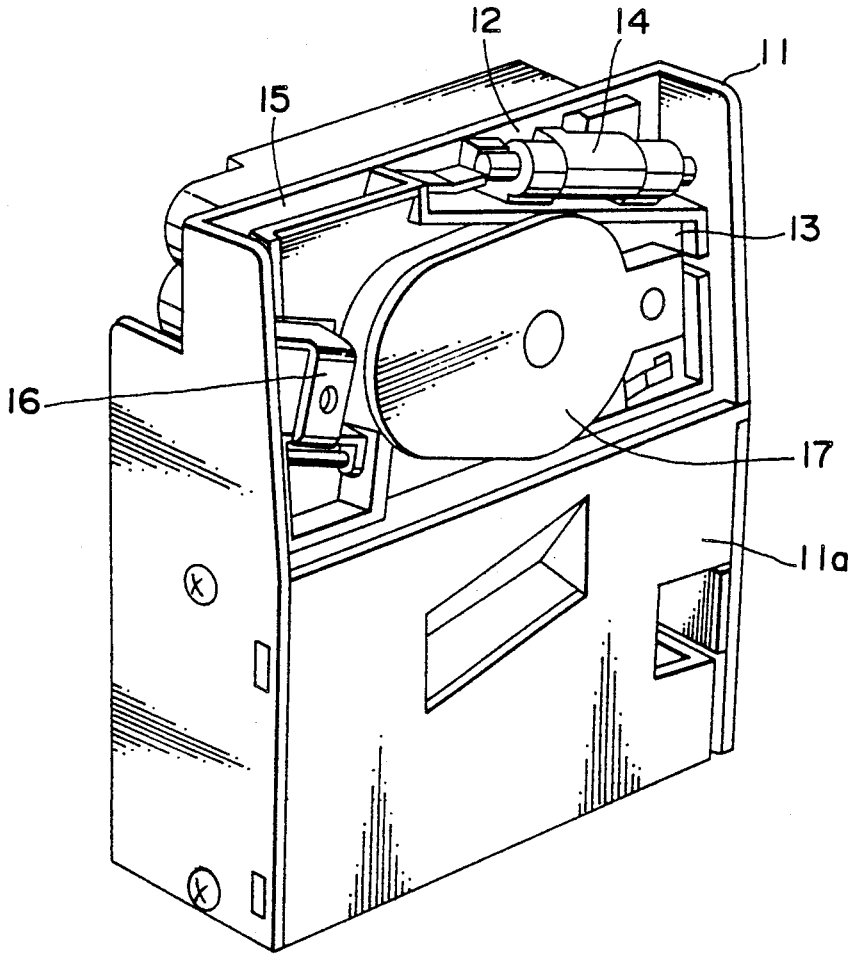
FIG. 7 is a perspective view of a coin acceptor of two way type arranged for the present invention.
Figure 8:
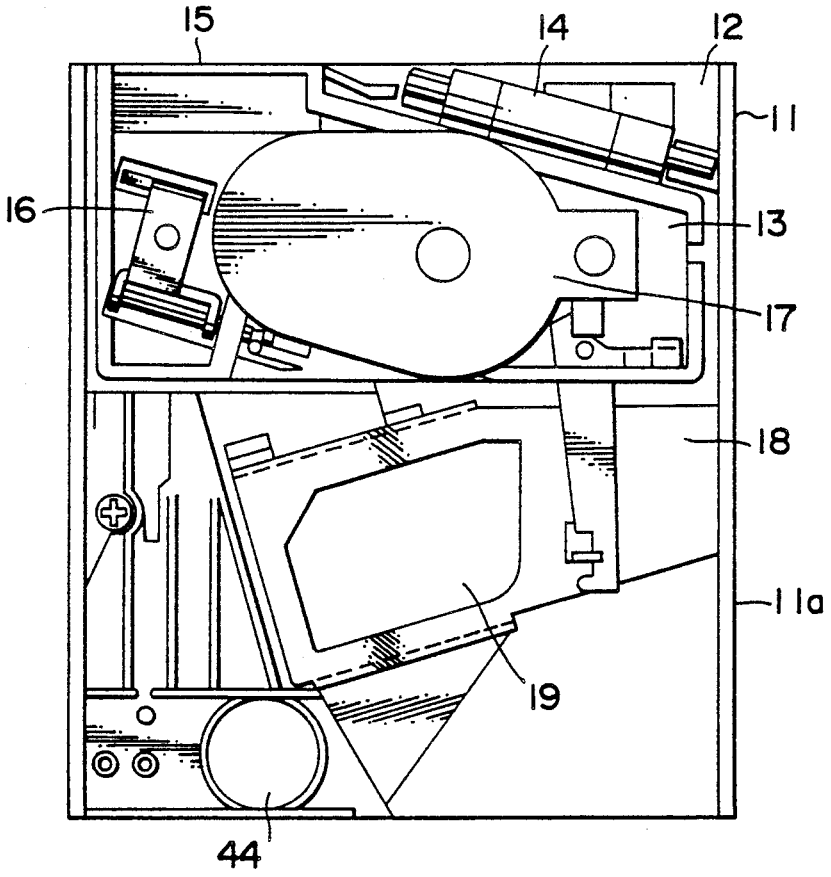
FIG. 8 is a front elevational view of the coin acceptor shown in FIG. 7 without a lower front cover.
Figure 9:
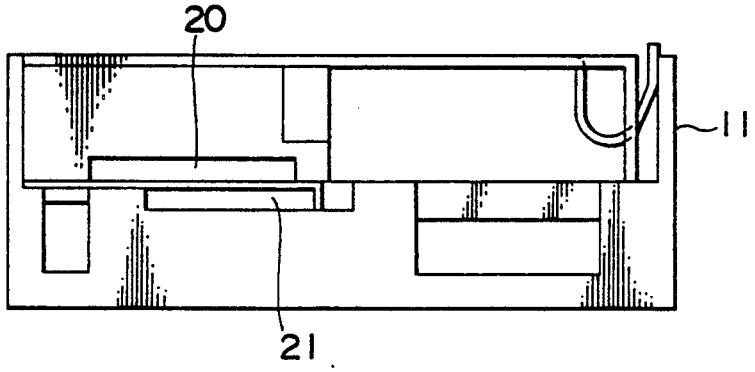
FIG. 9 is a bottom view of the coin acceptor shown in FIG. 7.
Figure 10:
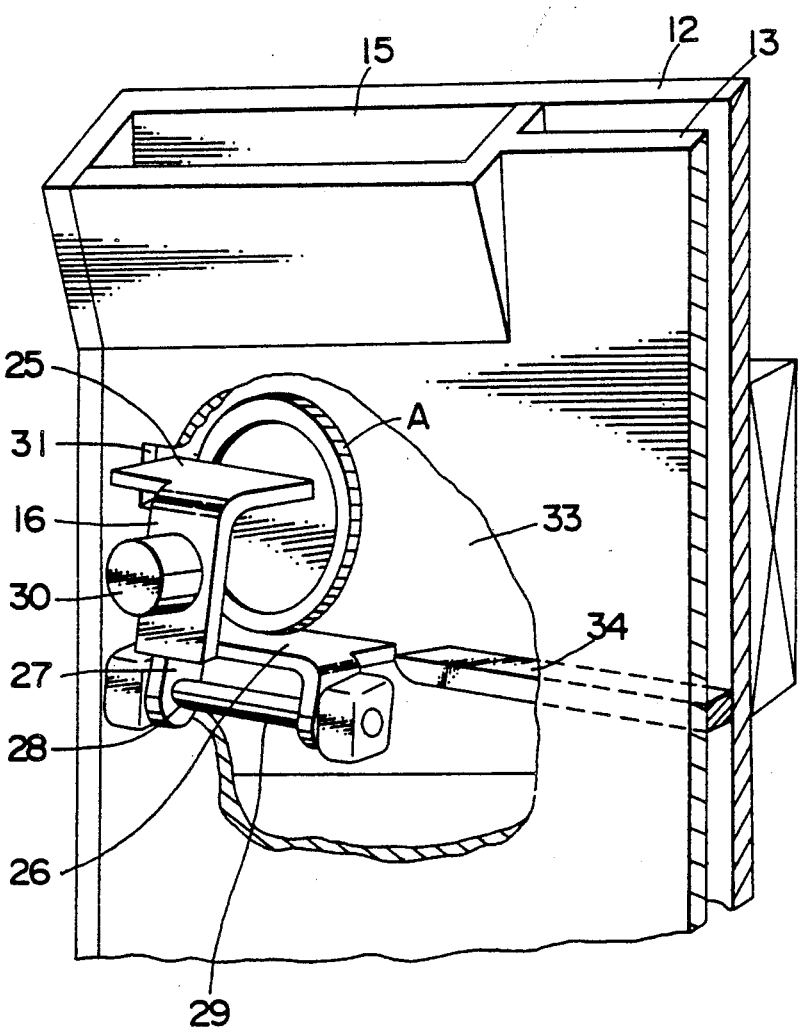
FIG. 10 is an enlarged partial perspective view illustrating an inlet portion of the coin acceptor shown in FIG. 7.

Referring to FIGS. 7~9 illustrating an embodiment of a coin acceptor for applying the method of the present invention, a main frame 11 includes a vertical stationary side plate 12. A movable side plate 13 is connected at the upper portion to one side of the side plate 12 by means of a hinge 14 such as to be opened downwardly. A coin to be discriminated is received at an inlet 15 and passed through a coin passage defined between the side plates 12 and 13.

A brake member 16 is arranged at a position under the inlet 15 and a pair of the oval sensor coils 17 are opposedly arranged at the opposite sides of the coin passage as mentioned below. In the under portion 11*a* of the main frame 11, there is an outlet 18 of the coin passage which is provided with a conventional solenoid operated gate (not shown) which is operated by an output signal from a control circuit connected to the sensor coil 17 and a genuine coin passage 19 which is arranged so as to selectively pass two kind of coins through a conventional branching device to outlets 20 and 21 for large and small genuine coins, respectively.

FIGS. 10 to 13 illustrate an embodiment of the brake member 16. In this embodiment, the body of the brake member 16 has an upper urging arm 25 and a lower coin receiving arm 26 which are parallely extended from upper and lower ends of the body towards the side wall 13. The lower coin receiving arm 26 is pivoted at a pivot portion 27 so as to be rockable towards the side plate 13 by means of pivoting holes 28 formed in the pivot portion 27 and a pivot shaft 29 fixed on the side wall 13. The body of the brake member 16 is provided with a balance weight 30 and a compression spring (not shown) is interposed between the body and the side plate 13 such as to hold the brake member 16 at an outwardly rotated position in which the upper coin urging arm 25 is withdrawn from an upper window 31 formed in the side plate 13 and the lower coin receiving arm 26 is protruded into the coin passage 33 through a lower window 32.

Figure 11:
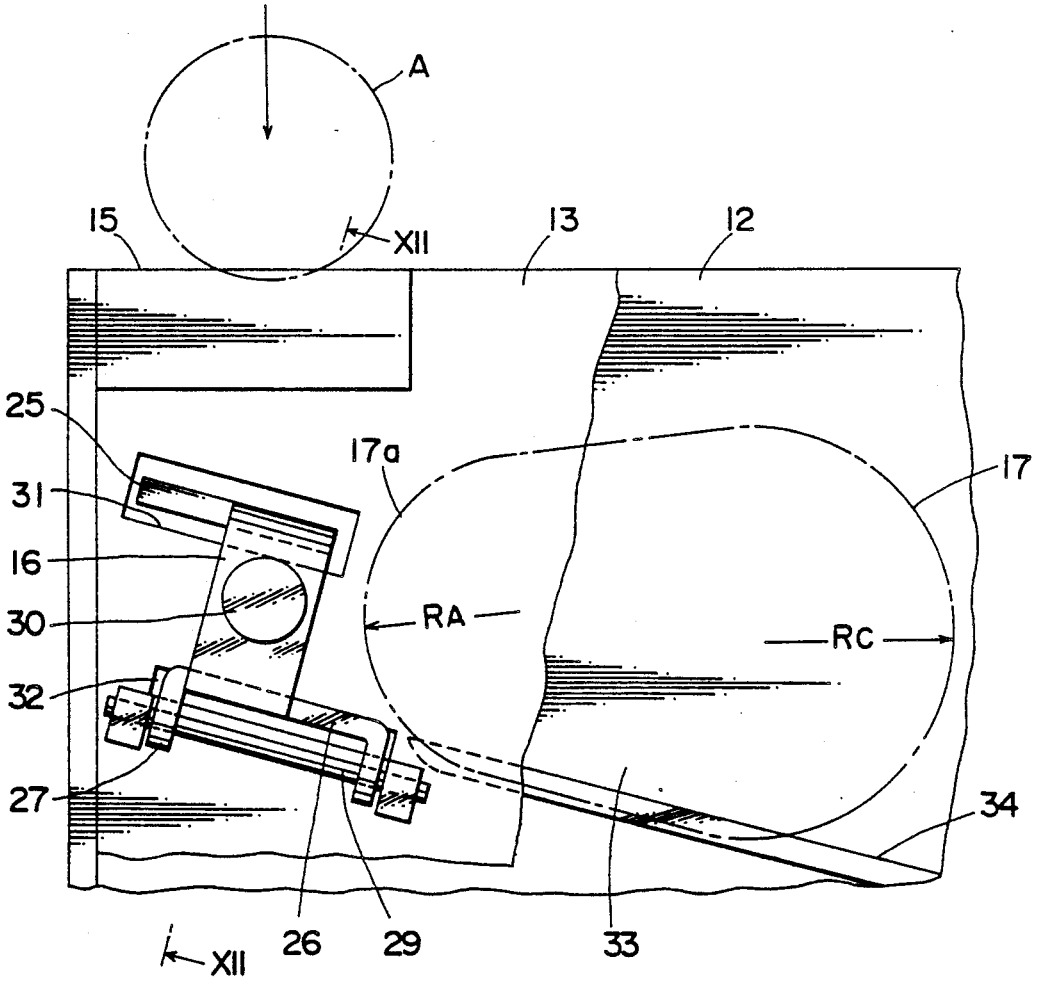
FIG. 11 is a front view of the portion shown in FIG. 10.
Figure 12:
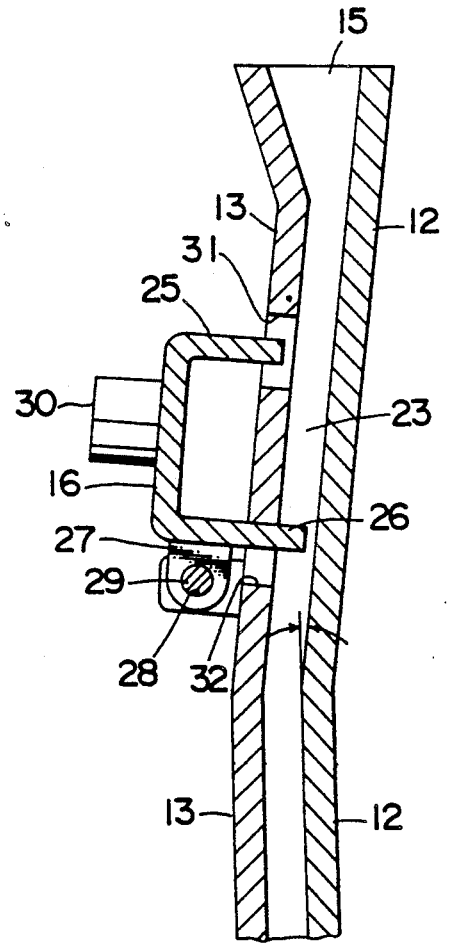
FIG. 12 is a sectional view taken along a line XII—XII in FIG. 11.
Figure 13:
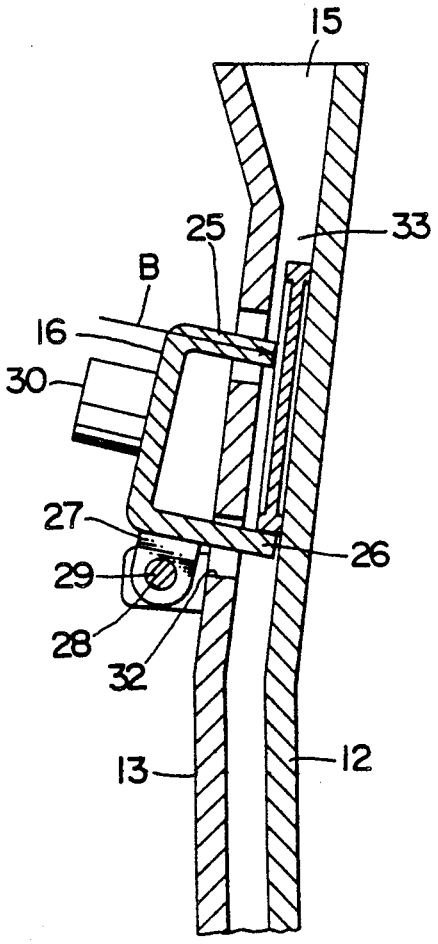
FIG. 13 is a sectional view similar to FIG. 12 illustrating an operation of a brake member.

With the above arrangement of the brake member 16, a coin A drops through the coin passage 33 from the inlet 15 and strikes the coin receiving arm 26 of the brake member 16 to thereby rotate the brake member 16 about the pivot shaft 29 towards the side plate 13 as shown in FIG. 13. Consequently, the upper coin urging arm 25 protrudes into the coin passage 23 to urge the coin A on the coin receiving arm 26 against the side plate 12 as shown by an arrow B. As the result, the kinematic energy applied to the coin A when the coin drops through the coin passage is decreased to substantially zero and the coin A is temporarily stopped. Thus stopped coin can be rolling on the coin receiving arm 26 towards the inclined guide rail 34 since the upper surface of the coin receiving arm 26 inclines at the same angle as that of the inclined guide rail 34 as shown in FIG. 11 and then passes between a pair of the oval sensor coils 17 at a constant speed through the coin passage 33.

The oval sensor coil 17 has an oval configuration in a section having one end in the longitudinal direction of a small radius of curvature RA corresponding to the diameter of the small coin to be discriminated and the other end of a large radius of curvature RB corresponding to the diameter of the large coin to be discriminated and is arranged on each of the side plates such as to extend the longitudinal axis of the oval sensor coil along the guide rail in the coin passage at each of the opposite sides of the coin passage. It is preferable to arrange the oval sensor coils such as to locate the end 17*a* of small radius of curvature at the inlet side of the coin passage 33.

Figure 14:
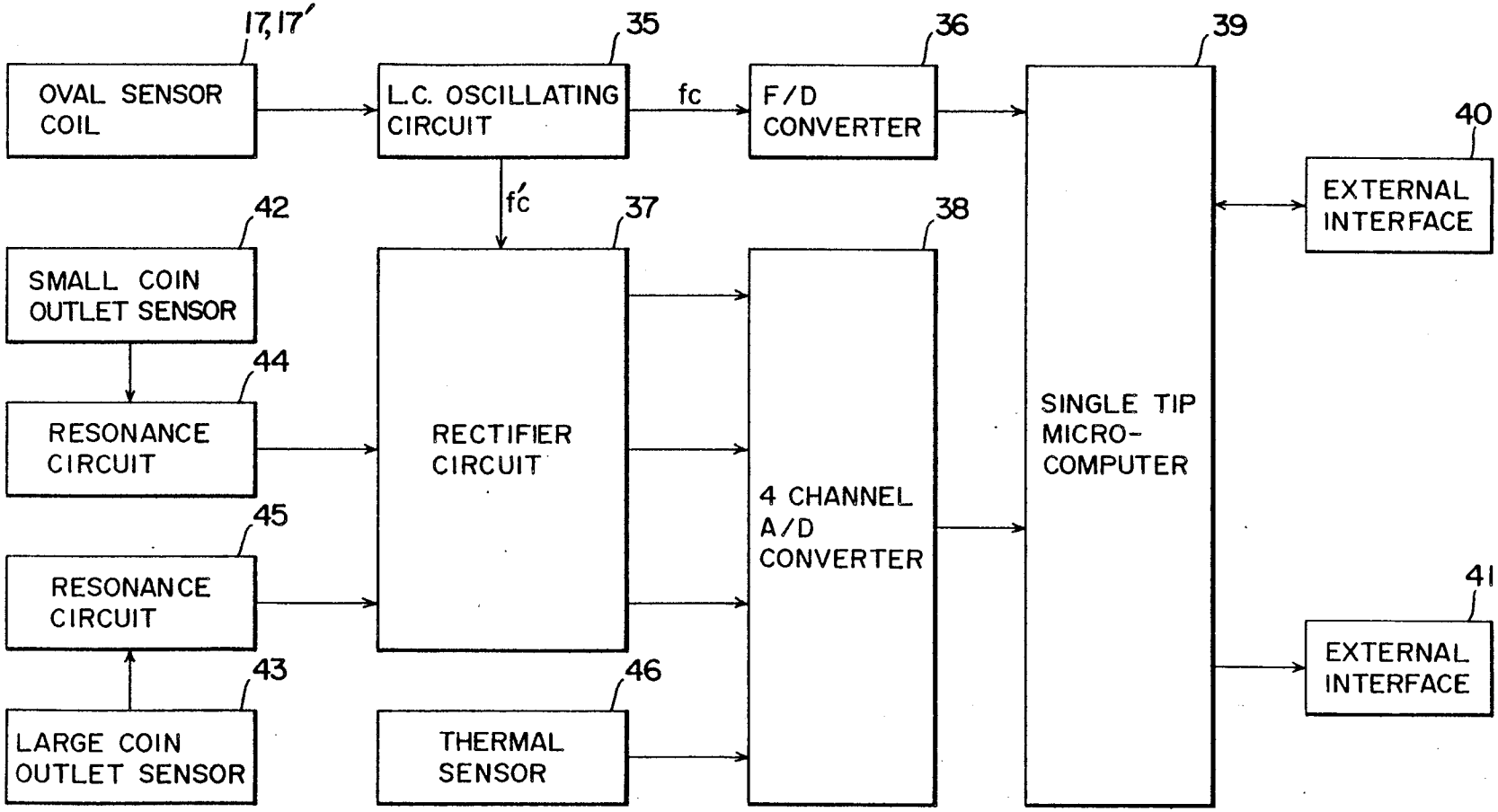
FIG. 14 is a block diagram of a two way coin discriminating circuit.

Referring to FIG. 14 showing an embodiment of a circuit for discriminating 100 yen coin and 500 yen coin, an L. C. oscillating circuit 35 connected to the opposedly arranged oval sensor coils 17, 17' is oscillated when the coin passes between the oval sensor coils. The output of variation of frequency is inputted to an F/D converter 36 and the output of variation of oscillating voltage is converted to a variation of DC voltage by a rectifier circuit 37 to input to an A/D converter 38. Clock pulses and digital signals of variations of the oscillation frequency and DC voltage from the F/D converter 36 and A/D converter 38 are inputted to a single tip microcomputer which outputs a trigger signal through external interfaces 40 and 41 to solenoids of electromagnetic gates for blanching the small coin and large coin. In FIG. 14, 42 and 43 designate outlet sensors for detecting acceptance of the small and large coins passing the outlet, respectively, 44 and 45 designate resonance circuit connected to the outlet sensors 42 and 43, respectively, and 46 is a thermal sensor for compensating the A/D converter with respect to the temperature for producing reference data.

Figure 15:
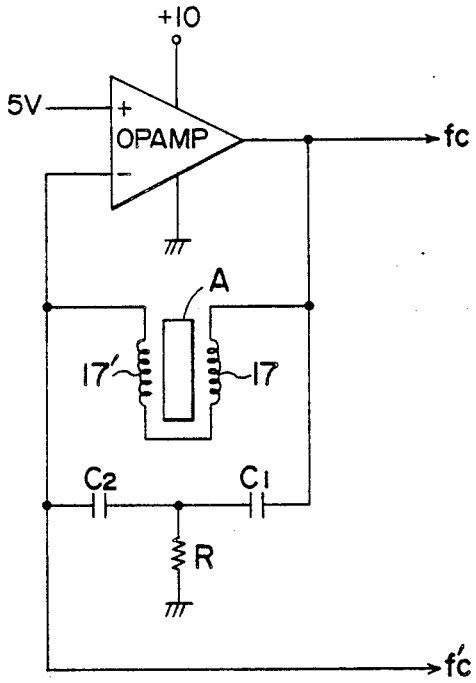
FIG. 15 shows the L. C. oscillating circuit shown in FIG. 14.

Referring to FIG. 15 showing an embodiment of an L. C. oscillating circuit 35 shown in FIG. 14, the L. C. oscillating circuit is composed of one stage of an operational amplifier (OPAMP) such as to oscillate in a range of 0~10 volts with a middle point of +5 volts to amplify the variation of reactance. The L. C. oscillating circuit 35 outputs an oscillation frequency signal fc for discriminating the material and thickness of the coin to the F/D converter 36 and an oscillation voltage signal fc' for discriminating the material, diameter and thickness of the coin to the rectifier circuit 37.

Figure 16:
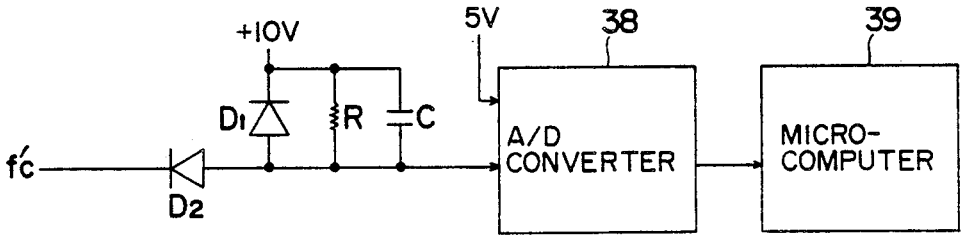
FIG. 16 shows the rectifier circuit shown in FIG. 14.

Referring to FIG. 16 showing an embodiment of the rectifier circuit 37 connected to the oscillating circuit 35, the rectifier circuit 37 converts the variations of oscillation voltage inputted from the oscillating circuit 37 to variations of DC voltage and outputs the converted signal to A/D converter 28 which convert the input signal to a digital signal and output it to the microcomputer 39.

Figure 17:
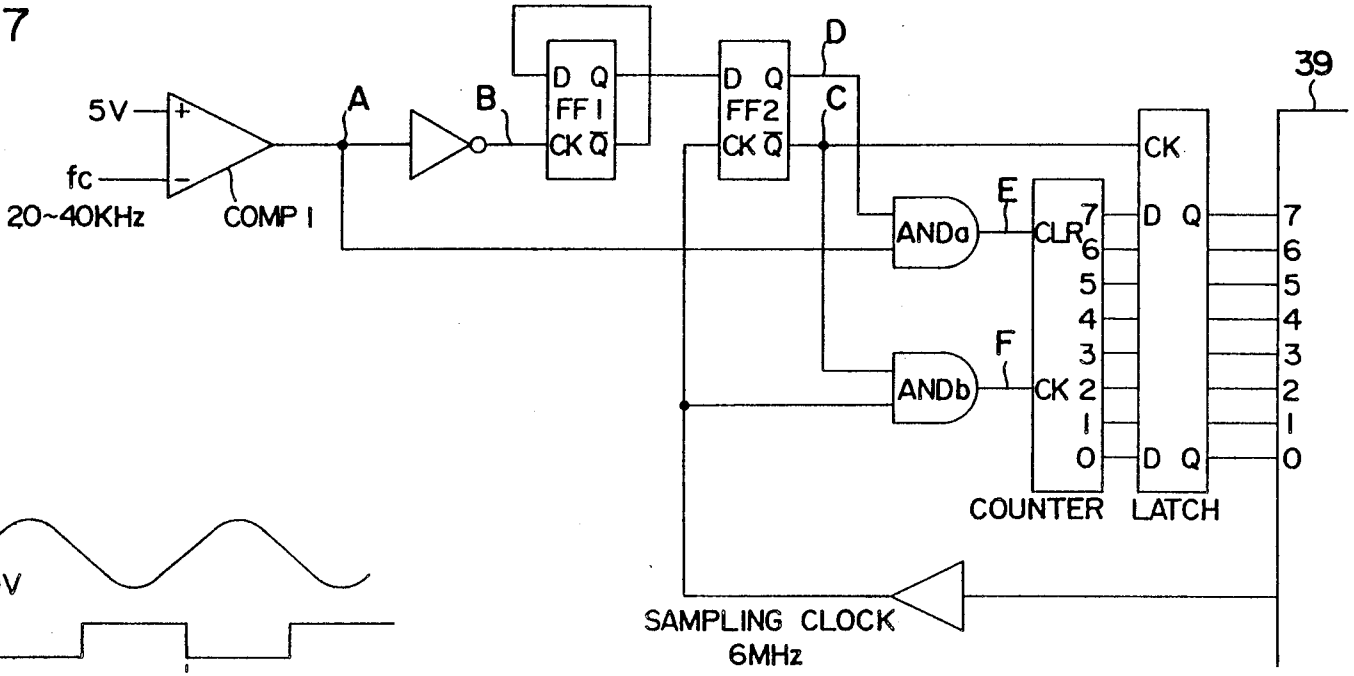
FIG. 17 shows a circuit diagram of the F/D converter shown in FIG. 14.

Referring to FIG. 17 showing an embodiment of the F/D converter circuit 36. The F/D converter converts the oscillation frequency signal fc to a clock signal of a TTL level via comparator COMP1. The frequency of the clock signal is divided to half frequency by a flip-flop FF1 and synchronized with the microcomputer 39 by a flip-flop FF2. The signal is sampled in high level by a sampling clock of 6 MHz.

Figure 18:
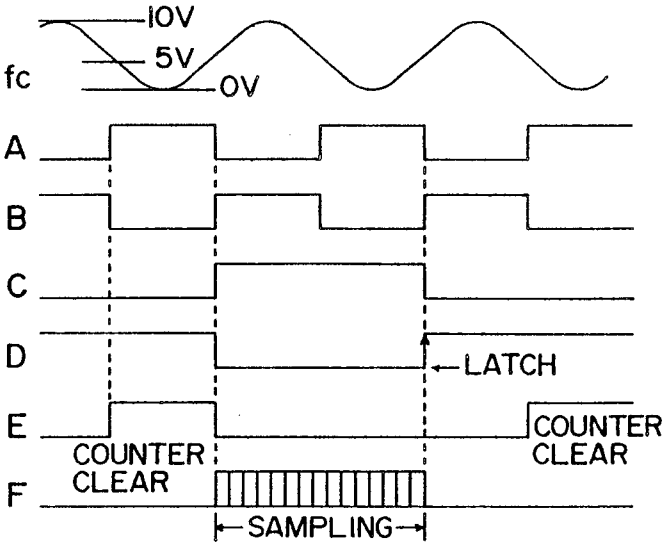
FIG. 18 shows a timing chart of the F/D converter shown in FIG. 17.

The data of the counter are stored in a latch and read out by the microcomputer 39. An ANDa gate outputs a clear signal to the counter and an ANDb gate outputs a clock signal to the counter. A timing chart of the F/D converter is shown in FIG. 18.

The reference data which is previously stored in the microcomputer 39 are provided by sampling a genuine coin in the same condition as that of discriminating coins. When coins to be discriminated are changed, only the reference data should be changed without any change of hardwares such as resistors and capacitors.

What is claimed is:

1. A method of discriminating coins by use of a pair of oval sensor coils opposedly arranged at both sides of a coin passage in a coin acceptor with the longitudinal axis of the coils extended along a coin guide rail in the coin passage, the method comprising steps of detecting a variation of coil reactance caused by a coin rolling on the guide rail, counting clock pulses in a pass time from a start point to a final point of the variation of coil reactance, reading the whole variation of the coil reactance from the start point to the final point thereof by a microcomputer, providing a plurality of variation divided data by dividing the pass time by an integral number and comparing the variation data with corresponding reference data of a genuine coin previously stored in the microcomputer.

2. A method as claimed in claim 1, wherein the whole variation of coil reactance is detected in the form of a variation of oscillation frequency and oscillating voltage by an L. C. oscillating circuit connected to the oval sensor coil.

3. A method claimed in claim 1, wherein the whole variation of coil reactance is substantially continuously detected.

4. A method claimed in claim 1, wherein a pair of the oval sensor coils are opposedly arranged at both sides of the inclined coin guide rail with one end in the longitudinal direction of the small radius of curvature RA positioned at the inlet side of the coin passage.

5. A method claimed in claim 1, wherein at the inlet side of the coin passage, the coin to be discriminated is dropped on an inclined receiving arm of a brake member and dropped coin is temporarily stopped on the inclined receiving arm by an urging arm of the brake member and subsequently started to roll on the inclined coin guide rail between the oval sensor coils at substantially constant speed.

* * * * *